United States Patent [19]

Black

[11] 4,133,848

[45] Jan. 9, 1979

[54] CARBURETION DEVICE

[76] Inventor: David L. Black, Box 1339, MacDill Air Force Base, Tampa, Fla. 33608

[21] Appl. No.: 790,342

[22] Filed: Apr. 25, 1977

[51] Int. Cl.[2] ..... F02M 7/14

[52] U.S. Cl. ..... 261/41 B; 261/44 A

[58] Field of Search ..... 261/41 B, 44 A, DIG. 56

[56] References Cited

U.S. PATENT DOCUMENTS

| | | | |
|---|---|---|---|
| 1,125,069 | 1/1915 | Coulter | 261/41 B |
| 1,176,516 | 3/1916 | Boyce | 261/41 B |
| 1,178,296 | 4/1916 | Cahill | 261/44 A |
| 1,393,366 | 10/1921 | Henderson | 261/41 B |
| 1,688,285 | 10/1928 | Purvis et al. | 261/41 B |
| 1,919,134 | 7/1933 | Schaffner | 261/41 B |
| 2,847,288 | 8/1958 | Taylor | 261/44 A |
| 3,350,073 | 10/1967 | Hill | 261/44 R |
| 3,464,803 | 9/1969 | Kimberley | 261/DIG. 56 |
| 3,752,454 | 8/1973 | Korponay | 261/41 B |
| 3,834,678 | 9/1974 | Baribeau et al. | 261/78 R |

FOREIGN PATENT DOCUMENTS

| | | | |
|---|---|---|---|
| 10510 of | 1906 | United Kingdom | 261/41 B |
| 181873 | 6/1922 | United Kingdom | 261/DIG. 56 |

*Primary Examiner*—Tim R. Miles

*Attorney, Agent, or Firm*—Reese Taylor

[57] ABSTRACT

Means are disclosed for an improved carburetor wherein fuel is atomized for carburetion purposes by being pumped through a tube having a plurality of perforations in its periphery. The tube is covered by sleeves which telescope over it; and in reaction to either depression or release of the accelerator, the sleeves will move along the tube to either uncover or cover more or less of the holes, as desired. In this way, a more completely atomized fuel mixture is delivered to the carburetor under high pressure for improved efficiency. Tension means are also provided to return the sleeves to their normal or "idle" position following release of the accelerator.

2 Claims, 5 Drawing Figures

CARBURETION DEVICE

FIELD OF THE INVENTION

This invention, in general, relates to carburetion devices and, in particular, relates to an improved apparatus for delivering fully atomized fuel under pressure to the mixing chamber of a carburetor.

DESCRIPTION OF THE PRIOR ART

The basic function of a carburetor is to produce the fuel and air mixture necessary for operation of an internal combustion engine. The more completely this mixture is atomized, the better the combustion and, thus, the more efficient and economical the operation of the engine.

Applicant is aware, of course, of conventional carburetor structures wherein air is sucked in through an air filter and around a tube filled with gasoline from the gasoline pump. In conventional carburetors, as the air rushes past the tube, it carries with it some of the gasoline vapor; and the mixture is then fed into the carburetor chamber. Normally, to vary the amount of the gas-air mixture going to the cylinder or chamber, a pivoted disc is utilized in the pipe leading from the air filter to the carburetor. This is opened upon depression of the accelerator, thereby varying the amount of air going to the carburetor and, therefore, the amount of air-gasoline mixture which enters the carburetor chamber. The present invention is an improvement to this general type system wherein the fuel is atomized more thoroughly, and the amount injected into the carburetor chamber can be readily controlled.

Applicant is also aware of certain prior art patents such as Gruffa U.S. Pat. No. 3,077,391 wherein an atomizing device is disclosed in which a plurality of plates having adjustable blades in the openings thereof which can be moved to different positions to create turbulence and improve the atomization of the mixture. Further known types of carburetors employing various atomization devices include Schneider U.S. Pat. No. 2,684,059, utilizing perforated discs; Proctor U.S. Pat. No. 3,648,674, utilizing grid screens; and Parkhill U.S. Pat. No. 1,940,226, utilizing a perforated pipe or strainer.

None of these patents, however, disclose the relatively simplified structure of the present invention which permits control of the amount of atomized fuel released into the chamber under pressure, with the result that fuel consumption is reduced, engine wear is reduced, and polluting emissions are severely reduced.

SUMMARY OF THE INVENTION

It has been discovered that an improved carburetion or fuel releasing device can be constructed by providing a main fuel tube connected to the gasoline pump and having a plurality of perforations in its periphery and opposed sleeves telescoping over that periphery. By means of a suitable linkage and starting from an idle position, the sleeves can be opened or moved away from each other so as to expose more of the perforations, thereby controlling the amount of fuel which goes into the carburetor or mixing chamber. This fuel is fed into the line under pressure and forced through the perforations in fine droplets or, in other words, is atomized for improved combustion.

It has also been found that spring means can be provided to return the sleeves to the idle position when the accelerator is released. In this way, between the linkage and the spring means the number of perforations in an exposed condition can be easily and readily controlled for improved engine performance.

Accordingly, production of an improved carburetion device of the character above-described becomes the principal object of this invention with other objects thereof becoming more apparent upon a reading of the following brief specification, considered and interpreted in view of the accompanying drawings.

OF THE DRAWINGS

DESCRIPTION OF THE PREFERRED EMBODIMENT

Figure 1:
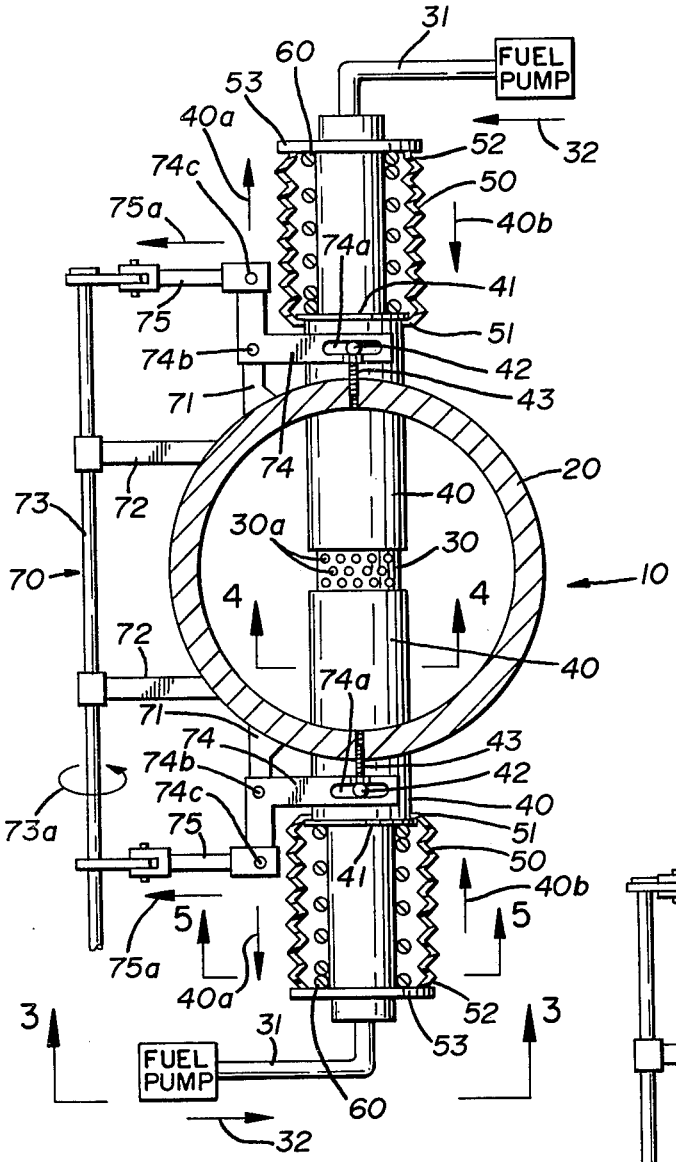
FIG. 1 is a plan view, partially in section, of the improved fuel supply device in the idle position.

Referring first to FIG. 1, it will be noted that the improved carburetion device, generally indicated by the numeral 10, includes a main carburetor mixing chamber 20 and a main fuel line 30. Also included are opposed sleeves 40, 40 which telescope over the main fuel line 30.

Still referring to FIG. 1, it will be noted that the main fuel line 30 is shown essentially schematically as an elongate tube or line having a plurality of perforations **30*a*, 30*a* disposed in its periphery. The opposed ends of the main fuel line 30 are connected to auxiliary lines 31, 31 which lead to the gasoline pump; and fuel or gasoline can be forced into the line under pressure, in the direction of the arrows 32, 32. The gas pump is shown schematically only; and any suitable pump such as, for example, a three diaphram mechanical pump can be used so long as the fuel arrives in main fuel line 30** under high pressure.

The sleeves 40, 40 are essentially elongate cylindrical members which are of sufficient internal diameter to slide along the periphery of the main line 30 in an axial direction, as will be described.

Secured to the one end 41 of each sleeve is one end 51 of bellows structures 50, 50; the other ends 52, 52 of which seat against plates 53, 53. This structure prevents dirt or grime from affecting operation of the sleeves or springs.

The plates 53, 53 are fixed in place for purposes which will be noted and also serve to support main fuel line 30.

Received within each of the bellows 50, 50 are coil springs 60, 60 which surround main fuel line 30 and each have one end seated against the plates 53, 53 and the opposed end secured, by any suitable means, to the ends 41, 41 of the sleeves 40, 40. Air may be supplied to the carburetor mixing chamber 20 through an air filter and intake manifold and can be controlled by a suitable air regulating valve. This structure is conventional and is not illustrated.

Figure 2:
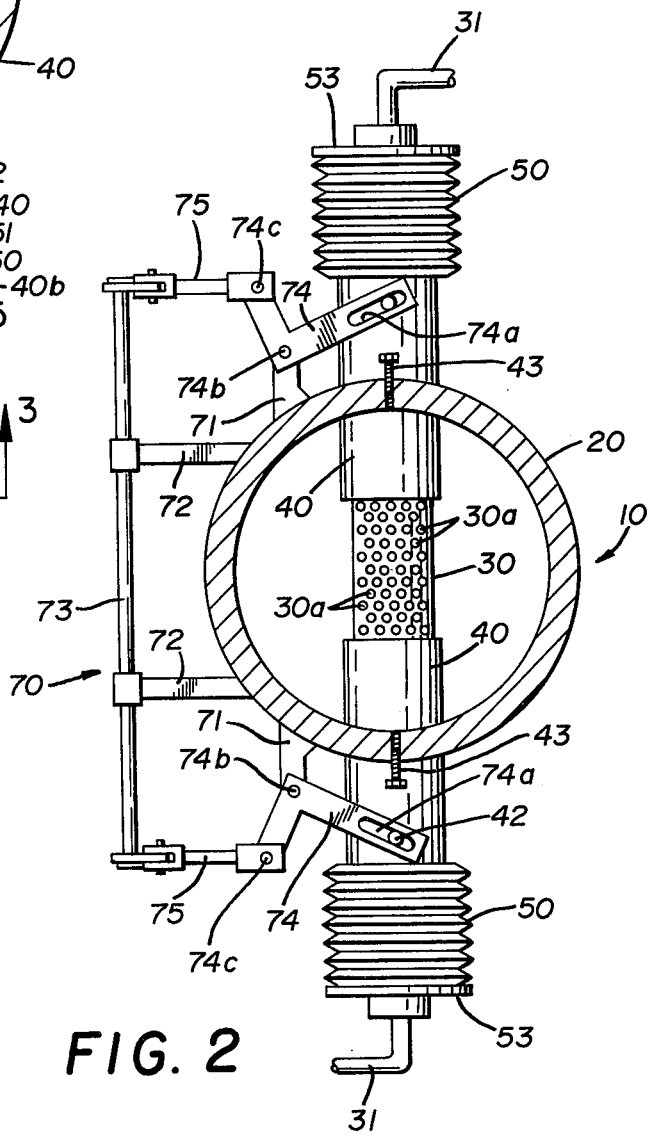
FIG. 2 is a view similar to FIG. 1 showing the sleeves in the open or acceleration position.
Figure 3:
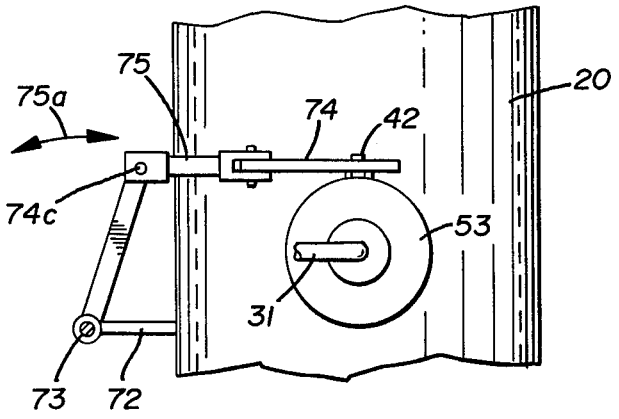
FIG. 3 is an elevational view taken along the line 3—3 of FIG. 1.
Figure 4:
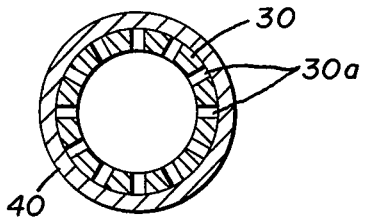
FIG. 4 is a sectional view taken along the line 4—4 of FIG. 1.
Figure 5:
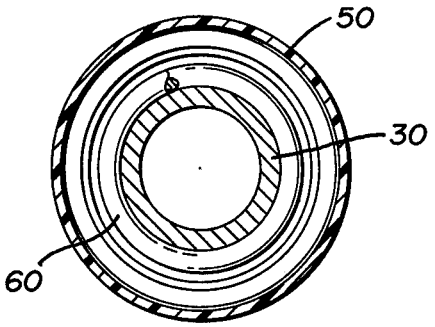
FIG. 5 is a sectional view taken along the line 5—5 of FIG. 1.

Turning next to FIGS. 1, 2 and 3 for a description of one form of linkage suitable to operate the improved carburetion device, it will be seen that each sleeve 40 carries a crankpin 42; and a linkage assembly 70 is associated therewith.

Specifically, first support arms 71, 71 are secured to the mixing chamber 20 or adjacent thereto. Second support arms 72, 72 are also provided for stability and carry a pivotable rod 73.

Secured to first support arms 72, 72 are L-shaped slotted arms 74, 74. These arms 74, 74 have slots **74*a*, 74*a* which cooperate with crankpins 42, 42 and are pivotally secured to first support arm 71, 71 at 74*b*, 74*b* and are also pivotally connected to connecting rods 75, 75 at 74*c*, 74*c*. In this fashion, movement of rod 73 in the direction of arrow 73*a* will move connecting rods 75, 75 in the direction of arrows 75*a*, 75*a* and, thus, sleeves 40, 40 in the direction of arrows 40*a*, 40*a***, as will now be described.

It will first be noted that FIG. 1 illustrates the invention in the "idle" position with some of perforations **30*a*, 30*a* uncovered. The spacing of the sleeves 40, 40** in this position may be predetermined so that enough fuel is released to run the engine in the "idle" condition.

It should be noted that the "idle" position itself may be controlled by utilizing stop screws 43, 43 on the carburetor mixing chamber (see FIG. 1). The crankpins 42, 42 will come to rest on these screws, thereby limiting movement of sleeves 40, 40 in the direction of arrows **40*b*, 40*b*. In this way, the number of perforations exposed in the "idle" position can be controlled by screwing stop screws 43, 43** either in or out, as desired.

In use or operation of the device, when it is desired to inject more fuel into the chamber 11 for acceleration, the accelerator is depressed and the linkage 70, which is connected thereto, will operate the sleeves 40, 40 in the direction of the arrows **40*a*, 40*a* or away from the midpoint of the chamber 20. This will cause a greater number of perforations 30*a*, 30*a* to be exposed and permit a greater amount of atomized fuel to be injected into the chamber 20** for combustion purposes.

Thus, movement of rod 73 about its axis in the direction of arrow **73*a* will move connecting rods 75, 75 in the direction of arrows 75*a*, 75*a*, as noted above. The slotted arms 74, 74 will pivot about points 74*b* and 74*c* and, in cooperation with crankpins 42, 42, will move sleeves 40, 40 in the direction of arrows 40*a*, 40*a* or, in other words, from the position of FIG. 1 to that of FIG. 2**.

When the accelerator is released, the springs 60, 60 acting against the plates 53, 53 will move the sleeves 40, 40 in the direction of the arrows **40*b*, 40*b* so as to close off the perforations 30*a*, 30*a* and reduce the entry of fuel into the mixing chamber 20**.

In this fashion, a greater or lesser amount of fuel, all of which has been atomized, can be injected into the mixing chamber for improved carburetion, depending on the sleeve positioning.

Therefore, improved engine efficiency can be obtained; and the engine will run cleaner and with reduced engine wear and reduced polluting emissions.

While a full and complete description of the invention has been set forth in accordance with the dictates of the Patent Statutes, it should be understood that modifications can be resorted to without departing from the spirit hereof or the scope of the appended claims.

Thus, for example, the invention generally has been illustrated in a schematic fashion, particularly with regard to the linkage and the fuel pump connection. It is believed apparent that any suitable linkage which will move the sleeves in the desired direction can be employed, and the invention is not intended to be limited to any specific linkage.

What is claimed is:

1. An improved carburetion device for use with an engine having a carburetor, a fuel pump for supplying fuel under high pressure and an accelerator, comprising;

(A) a main fuel line
  (1) connecting to the fuel pump,
  (2) having a plurality of perforations in its periphery, and
  (3) passing through the air filled mixing chamber of the carburetor
    (a) whereby the fuel is forced through said perforations, atomized and mixed with the air;

(B) a pair of cylindrical sleeves telescoped over said main fuel line and slidable therealong;

(C) means attached to said sleeves for moving them toward and away from each other; and (D) said last mentioned means including springs secured to said sleeves and surrounding said main fuel line for normally urging said sleeves toward each other.

2. An improved carburetion device for use with an engine having a carburetor, a fuel pump for supplying fuel under high pressure and an accelerator, comprising:

(A) a main fuel line
  (1) connected to the fuel pump,
  (2) having a plurality of perforations in its periphery, and
  (3) passing through the air filled mixing bowl of the carburetor
    (a) whereby the fuel is forced through said perforations, atomized and mixed with the air;

(B) a pair of cylindrical sleeves
  (1) slidingly disposed over said main fuel line in opposed relationship, and
  (2) at least partially extending into the mixing bowl of the carburetor;

(c) an operating linkage interconnecting the accelerator and said sleeves for translating accelerator movement into linear movement of said sleeves away from each other;

(D) tension means
  (1) surrounding each of said sleeves and said main fuel line and secured thereto, and
  (2) normally urging said sleeves toward each other;

(E) collapsible protective members surrounding said sleeves and said tension means; and (F) adjustable stop means
  (1) secured to the mixing bowl of the carburetor in opposed relationship, and
  (2) engagable with a part of said linkage as said sleeves are moved toward each other.

* * * * *